US010590595B2

(12) United States Patent
Kalze et al.

(10) Patent No.: US 10,590,595 B2
(45) Date of Patent: Mar. 17, 2020

(54) METHOD AND ENERGIZATION CIRCUIT FOR AN INDUCTION-HEATED LAUNDRY DRYER

(71) Applicant: Miele & Cie. KG, Guetersloh (DE)

(72) Inventors: Oliver Kalze, Harsewinkel (DE); Martin Schulze Hobeling, Ostbevern (DE); Ludger Laame, Geseke (DE)

(73) Assignee: MIELE & CIE. KG, Guetersloh (DE)

( * ) Notice: Subject to any disclaimer, the term of this patent is extended or adjusted under 35 U.S.C. 154(b) by 313 days.

(21) Appl. No.: 15/814,452

(22) Filed: Nov. 16, 2017

(65) Prior Publication Data

US 2018/0148886 A1 May 31, 2018

(30) Foreign Application Priority Data

Nov. 25, 2016 (DE) ..... 10 2016 122 744

(51) Int. Cl.

| | |
|---|---|
| ***D06F 58/28*** | (2006.01) |
| ***D06F 58/26*** | (2006.01) |
| ***H05B 6/06*** | (2006.01) |
| *D06F 58/04* | (2006.01) |

(52) U.S. Cl.

CPC ..... *D06F 58/28* (2013.01); *D06F 58/26* (2013.01); *H05B 6/06* (2013.01); *D06F 58/04* (2013.01); *D06F 2058/289* (2013.01); *D06F 2058/2854* (2013.01); *D06F 2058/2893* (2013.01)

(58) Field of Classification Search

CPC ..... D06F 58/28; D06F 58/26; D06F 58/04; D06F 2058/2854; D06F 2058/289; D06F 2058/2893; H05B 6/06

See application file for complete search history.

(56) References Cited

U.S. PATENT DOCUMENTS

| | | | | |
|---|---|---|---|---|
| 2011/0120989 A1 * | 5/2011 | Schilling | ..... | H05B 6/062 219/661 |
| 2015/0060439 A1 | 3/2015 | Pankratz et al. | | |

FOREIGN PATENT DOCUMENTS

| | | | | |
|---|---|---|---|---|
| DE | 4212700 A1 | 10/1993 | | |
| DE | 4313538 A1 | 10/1994 | | |
| DE | 10258845 A1 | 1/2004 | | |
| DE | 102009026646 A1 | 12/2010 | | |
| DE | 102009047185 A1 | 6/2011 | | |
| DE | 102012207847 A1 | 11/2013 | | |
| DE | 102016110859 B3 | 6/2017 | | |
| EP | 2330866 A2 | 6/2011 | | |
| EP | 2400052 A1 | 12/2011 | | |
| EP | 2642018 A2 | 9/2013 | | |
| FR | 2671929 A1 * | 7/1992 | ..... | H03L 5/02 |
| WO | WO-2011010474 A1 * | 1/2011 | ..... | H05B 6/06 |

* cited by examiner

*Primary Examiner* — Jeremy Carroll

(74) *Attorney, Agent, or Firm* — Leydig, Voit & Mayer, Ltd.

(57) ABSTRACT

A method for energizing an induction heater of a laundry dryer includes energizing the induction heater to heat a drum of the laundry dryer; interrupting the energization of the induction heater for a time interval, allowing an oscillator circuit of the induction heater to freely oscillate; measuring a resonant frequency of the oscillator circuit during the time interval; and determining a temperature of the drum based on the measured resonant frequency.

11 Claims, 3 Drawing Sheets

METHOD AND ENERGIZATION CIRCUIT FOR AN INDUCTION-HEATED LAUNDRY DRYER

CROSS-REFERENCE TO PRIOR APPLICATION

Priority is claimed to German Patent Application No. DE 10 2016 122 744.7, filed on Nov. 25, 2016, the entire disclosure of which is hereby incorporated by reference herein.

FIELD

The present invention relates to a method for energizing an induction heater of a laundry dryer and to a corresponding energization circuit.

BACKGROUND

It is known to heat the drum of a laundry dryer directly by means of an electrical resistance heating element. DE 43 13 538 A1, for example, describes a device for drying textile material in dryer drums. In order to deliver heat from the heater as directly as possible to the textile material to be dried, one or more electrical resistance heating elements are disposed on the outer or inner surface of the cylindrical drum wall and fixedly attached thereto. This aims at increasing the efficiency of the laundry drying process.

The disadvantage here is that an electrical connection must be provided to the electrical resistance heating elements, which rotate with the drum. This can be achieved using, for example, brush contacts. However, this is complex and therefore expensive. Moreover, the brush contacts are subject to considerable wear, so that such approaches for electrically contacting relatively moving contact partners have a limited service life. This may result in increased maintenance and servicing costs of such laundry dryers.

Another disadvantage is that the generation of heat is accomplished directly by electric current, which may result in high power consumption of such electrically heated laundry dryers. This leads to an inefficient way of drying laundry, which, today, is undesirable in view of increasing electricity costs and from an environmental impact point of view.

Also known in the art are heat pump dryers. These have a closed heat pump circuit, including a compressor, an evaporator, a condenser and a restriction device (e.g., a capillary tube or an expansion valve). Via this heat pump circuit, moisture that has previously been removed from the laundry is removed from the process air. To this end, the process air previously heated and dehumidified by the heat pump circuit is delivered through an air supply duct into a drum of the laundry dryer by means of a fan. In the drum, the laundry to be dried is typically moved by rotation so that the process air can reach the laundry as completely and uniformly as possible.

In the process, the heated process air absorbs moisture from the laundry, thereby drying it. The moist process air is then returned via an air return duct to the heat pump circuit. There, the moisture removed from the laundry is condensed from the process air and discharged in liquid form to the outside. The energy extracted from the air in this process is returned to the process air, so that the process air exits the heat pump circuit in a reheated condition in a direction toward the drum. The process air cycle is thereby closed. Examples of heat pump dryers are found in EP 2 642 018 A2 and DE 42 12 700 A1.

A heat pump dryer is a condenser dryer that heats the process air by convection. The process air heats the laundry by convection and evaporates the water. Subsequently, the warm and moist air is dehumidified and cooled in the air condenser (heat pump evaporator). In this connection, it is necessary to ensure superheating prior to entry into the compressor of the implemented heat pump circuit; i.e., the compressor may only draw in dry steam, but no two-phase mixture, because this would result in failure of the compressor.

The state of the refrigerant is highly dependent on pressure and temperature. These two variables, and thus the entire heat transfer process, are strongly influenced by the enthalpy flow of the process air and the incipient condensation at the heat transfer surface of the air condenser. This means that, in order to minimize the drying time, the process must be controlled so as to increase the enthalpy flow of the process air, to adjust it to the operating range of the heat pump, to ensure superheating, and at the same time to condense as much water as possible from the process air.

While heat pump dryers are significantly more energy-efficient than laundry dryers having electrical resistance heating elements, the temperature range they can achieve with their heat pump is significantly smaller and at a lower temperature level. This can lead to significantly longer drying times, which may result in increased stress on the laundry due to the increased duration of the mechanical movement. Also, especially at the beginning of the drying process, it can take a relatively long time for the drum to heat to the target temperature. This also increases the drying time.

In order to assist and speed up the drying process, and thereby also minimize the stress on the laundry, an additional heating source may be provided. It is generally known to heat the drum of a laundry dryer by means of an induction heater. For optimum process operation and minimum drying time, the drum temperature must be measured and controlled by adjusting the heat output. This requires that the drum temperature be measured with sufficient accuracy.

One way of doing this is to measure the temperature of the drum directly using an external sensor, such as an infrared sensor. However, this is disadvantageous for various reasons. On the one hand, this adds to the complexity and expense of manufacturing the respective appliance, especially if, for example, a black coating has to be applied to the outside the drum to ensure proper temperature measurement. On the other hand, this increases the risk of failure; i.e., reduces the reliability of the appliance, because the sensor may fail or become unable to measure properly. Optical infrared sensors, for example, may easily become contaminated, for example, by lint, which inevitably forms in the dryer. A possibly required outer coating of the drum may change its properties with time or become damaged, and thus also impair the reliability of the measurement.

SUMMARY

In an embodiment, the present invention provides a method for energizing an induction heater of a laundry dryer, the method comprising: energizing the induction heater to heat a drum of the laundry dryer; interrupting the energization of the induction heater for a time interval, allowing an oscillator circuit of the induction heater to freely oscillate; measuring a resonant frequency of the oscillator circuit during the time interval; and determining a temperature of the drum based on the measured resonant frequency.

DETAILED DESCRIPTION

Figure 1:
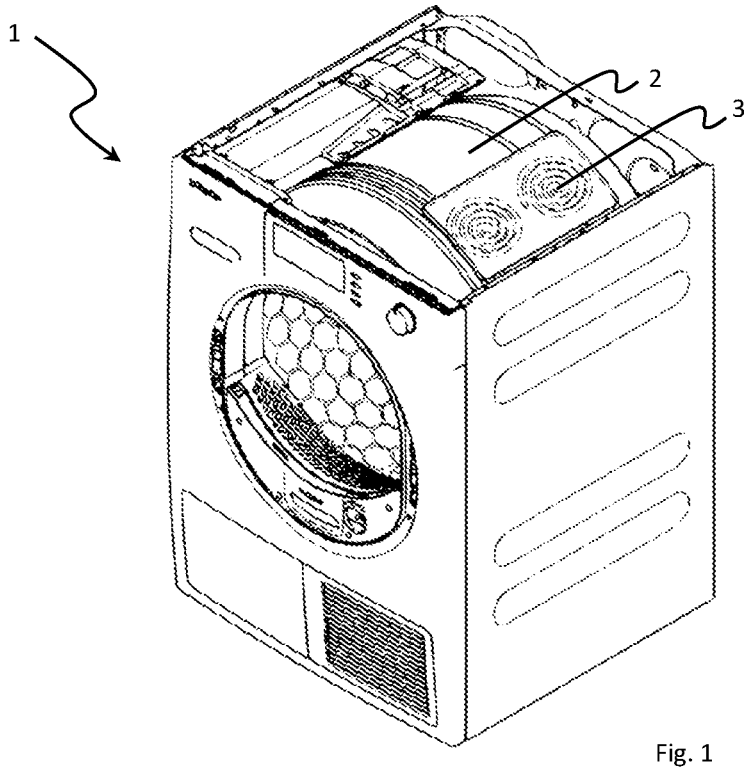
FIG. 1 shows an embodiment of a dryer according to the present invention.

In a first aspect, a method is provided including:

energizing an induction heater to heat the drum of a laundry dryer;

interrupting the energization of the induction heater for a time interval, allowing the oscillator circuit of the induction heater to freely oscillate;

measuring the resonant frequency of the oscillator circuit during the time interval; and determining the temperature of the drum based on the measured resonant frequency.

In an induction heating system of a laundry dryer, an oscillator circuit is composed of the induction coil that heats a ferromagnetic material (in this case the dryer drum) and an additional capacitor. In such a system, the temperature of the ferromagnetic material (of the dryer drum) can be inferred by measuring the resonant frequency of the oscillator circuit.

In ferromagnetic materials, such as are needed for an induction heater, the relative magnetic permeability $\mu_r$ is dependent on the temperature of the material. The inductance of a coil (in this case a combination of the induction coil and the portion of the dryer drum that is covered by the induction coil) is proportional to the relative magnetic permeability $\mu_r$: $L \sim \mu_r$.

The change in inductance with temperature results in a change in the resonant frequency of an oscillator circuit. Thomson's oscillation formula applies:

$$f_0 = \frac{1}{2\pi\sqrt{LC}}$$

Using this relationship in accordance with the present invention, the temperature of the dryer drum can be inferred from the measurable resonant frequency, which is directly dependent on the temperature.

In an embodiment, the method further includes: filtering the measured resonant frequency to account for rotation of the drum.

In the special situation of a rotating drum of a dryer, the resonant frequency is subject to variation because of, for example, slight imbalances caused by the laundry as it is carried along; the temperature derived therefrom varies as well. The variation essentially does not result from temperature fluctuations, but from changes in distance between the induction heater and the drum. Furthermore, the resonant frequency typically has a more dynamic response than the temperature. In order to derive a reliable value for the temperature therefrom, the measured resonant frequency may be filtered, for example, by rolling average calculation or using a digital low-pass.

In an embodiment, the method further includes: interrupting the heating of the drum or reducing the output of the induction heater if the particular temperature is above a predetermined threshold, the temperature threshold having a value between 45° C. and 140° C.

In an embodiment, the induction heater is operated with AC voltage and the time interval is shortly before a zero crossing of the AC voltage, the time interval being 1-3 periods, preferably 2 periods of the oscillator circuit. In an exemplary embodiment, the time interval is in the last 10-15% of the period length before the zero crossing.

In a second aspect, an energization circuit is provided for an induction heater of a drum or a laundry dryer, the energization circuit including a microcontroller adapted to carry out the method as described above.

In a third aspect, a laundry dryer is provided including:

an induction-heatable and rotatable drum;

an induction heater adapted to heat the drum and covering at least a portion of the drum; and an energization circuit as described above.

In an embodiment, an additional ferromagnetic material is attached to at least one portion of the drum, and the energization circuit is adapted to measure the resonant frequency of the oscillator circuit during a time interval in which the induction heater covers the attached ferromagnetic material.

The method of the present invention requires that the magnetic properties of the drum material to be heated change with temperature to a sufficient degree. It is only under these conditions that the drum temperature can be calculated with sufficient accuracy from the resulting resonant frequency of the oscillator circuit. In this embodiment, if the resonant frequency does not sufficiently change in the temperature range of interest because of the properties of the drum material, a suitable ferromagnetic material may be attached to the drum and used for the measurement. Ideally, this material significantly changes the relative magnetic permeability in the temperature range of interest (e.g., 45° C.-140° C.).

This includes both attachment of an additional material around the entire circumference and attachment around part thereof. Also included is the attachment in various locations on the drum. In cases of non-continuous attachment, the measurement can then be carried out periodically in the time interval when the additional material attached to the dryer drum is located in the region of the induction coil. In the case of continuous attachment, the time interval can be freely selected because in this case the material is always located in the region of the induction heater, irrespective of the angular position of the drum.

In an embodiment, the attached ferromagnetic material differs in its magnetic behavior from the material of the drum and is attached only to at least one portion of the drum, and the energization circuit is adapted to detect, based on the change in the magnetic behavior, whether the drum rotates or is at rest; the energization circuit being adapted to turn off the induction heater when the drum is detected to be at rest.

This embodiment may also be used when the drum material already changes sufficiently with temperature. However, this embodiment is particularly advantageous especially in cases where the additional material is attached to ensure the desired measurement accuracy because in this case, it is possible to also sense rotation of the drum without additional complexity.

FIG. 1 shows a dryer 1 according to an embodiment of the present invention, including an energization circuit used in the inventive method. An induction heater 3 is disposed at drum 2, the induction heater heating the material of drum 2 (or a ferromagnetic material attached thereto).

Figure 2:
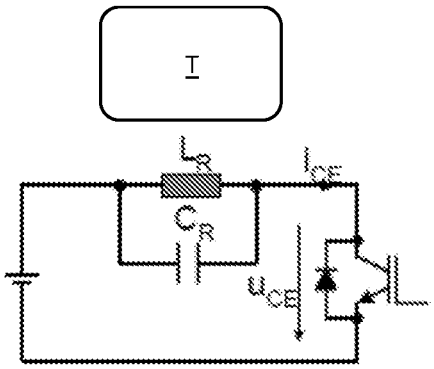
FIG. 2 shows a circuit topology, such as can be used with the present invention.

FIG. 2 shows, by way of example, the circuit topology of a quasi-resonant inverter. The circuit includes an insulated-gate bipolar transistor (IGBT) which generates the high-frequency voltage for energizing induction coil $L_R$. Induction coil $L_R$, together with the adjacent drum T or a ferromagnetic material attached thereto, forms the inductance of the oscillator circuit. The oscillator circuit further includes a capacitor $C_R$.

In order to measure the resonant frequency of the oscillator circuit, the energization is briefly turned off and interrupted, allowing the system (oscillator circuit voltage $u_{CE}$) to freely oscillate for a short period of time. The resonant frequency is measured during this period of time. To this end, one or more periods of the oscillator circuit voltage may be analyzed. The measurement is performed using a comparator and an internal timer of the microcontroller. After the measurement, the inverter is operated in its normal operating mode again in order to heat. The measurement period is relatively short compared to the heating period, so that the output of the induction system is hardly affected.

Figure 3:
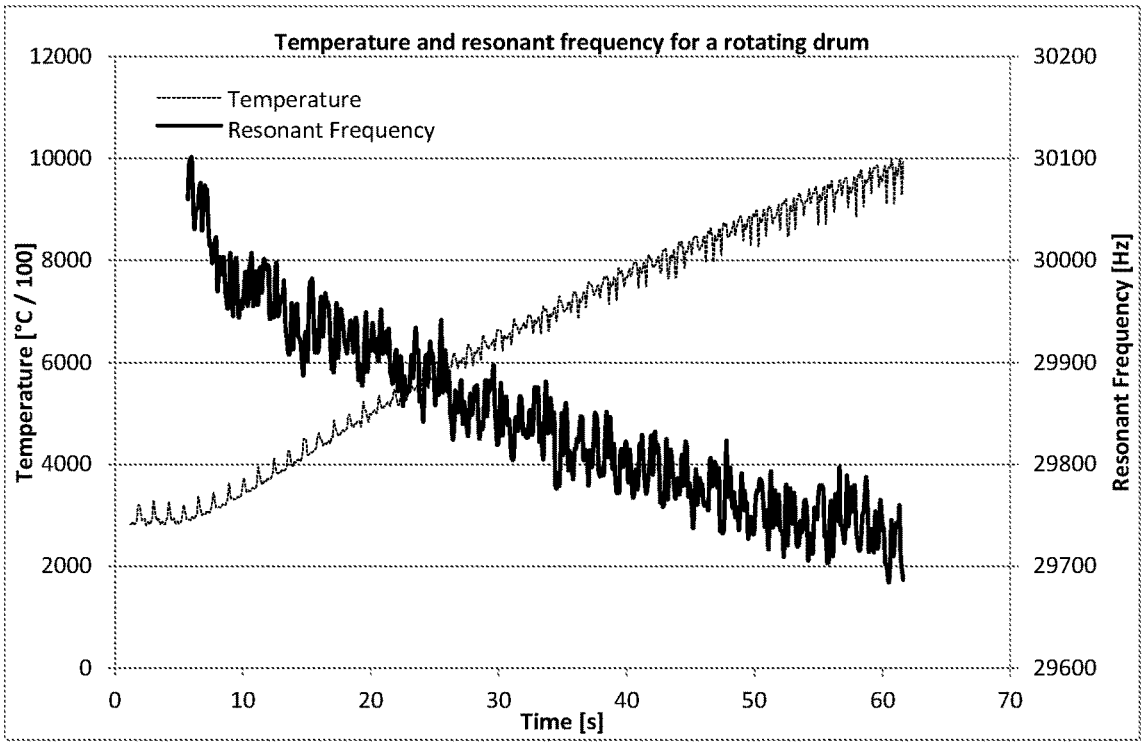
FIG. 3 is a diagram showing the variation with time of the measured drum temperature and resonant frequency.

FIG. 3 shows an exemplary diagram showing the variation with time of the drum temperature (measured with an IR temperature sensor) and the resonant frequency at an induction heater output of P=1000 watts. Shown here is a temperature range from about 30° C. to 100° C., but other temperature ranges, such as 45° C.-140° C., are also possible The dryer drum rotates during the entire measurement, as can be seen from the fluctuating signals. The drum does not have the same temperature at all points around its circumference because of imbalances, inhomogeneities, and other tolerances present in the system. The signal fluctuations can be reduced by further filtering the measured resonant frequency. The filtering may be performed using a digital filter (software filter, such as rolling average calculation, digital low-pass filter) in the microcontroller software.

Figure 4:
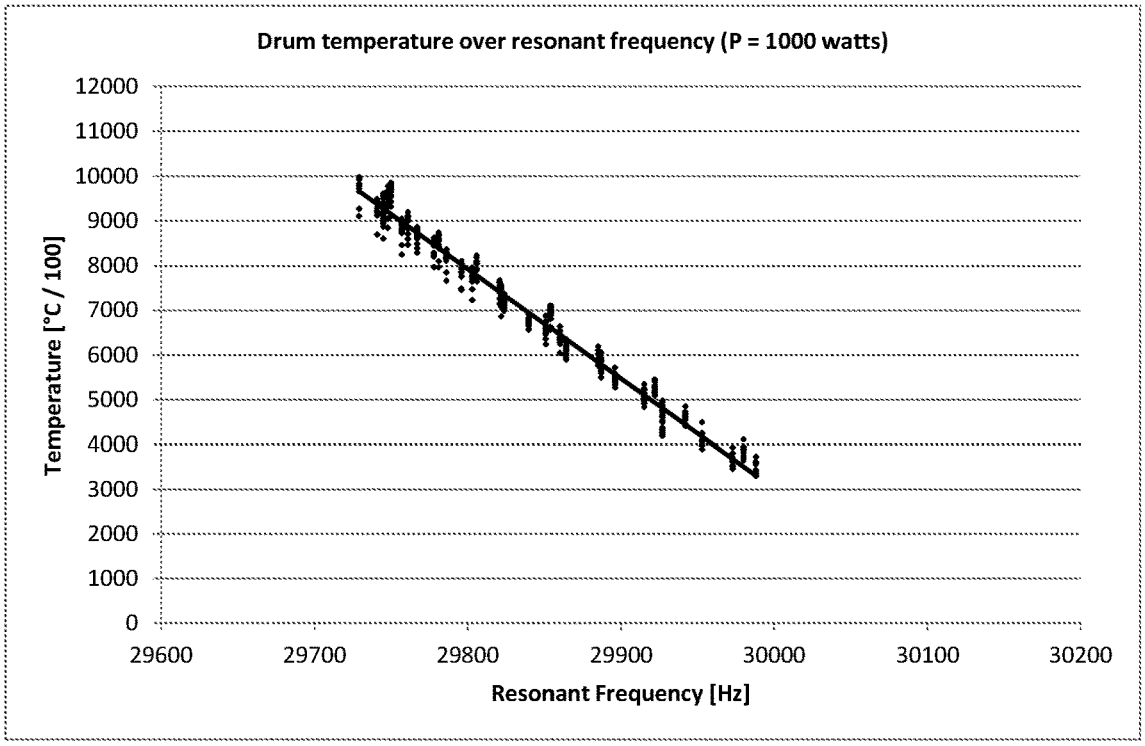
FIG. 4 shows a diagram which can be used to derive the drum temperature from the resonant frequency in accordance with the present invention.

FIG. 4 illustrates the relationship between the resonant frequency and the temperature, as derived from the waveforms of FIG. 3. Based on this recognized relationship, the temperature of the dryer drum can be derived with the required accuracy from the measured resonant frequency of the oscillator circuit without having to measure it directly (for example, using an IR temperature sensor).

Figure 5:
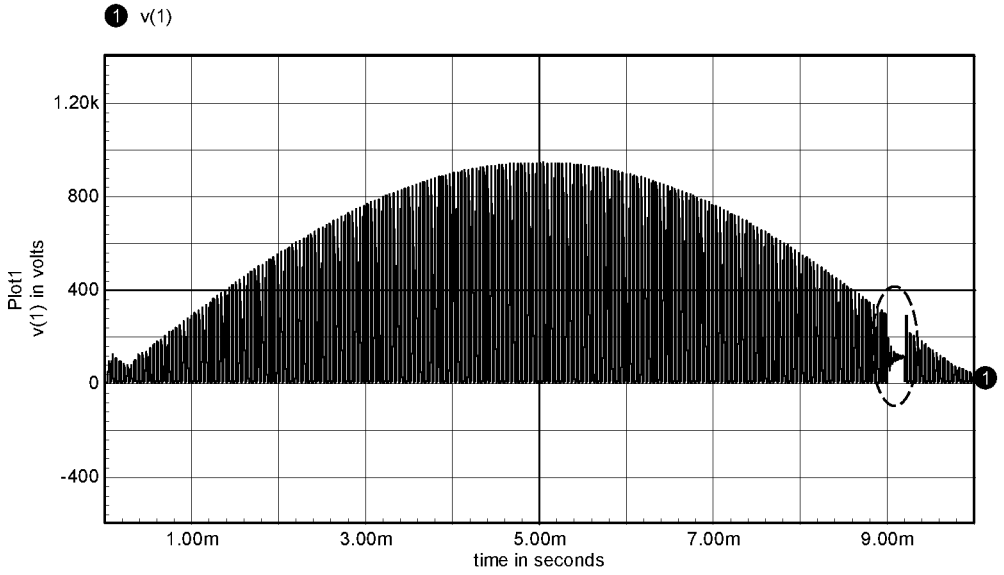
FIG. 5 shows a pulse waveform diagram of the energization of the oscillator circuit.

FIG. 5 shows the waveform of energization pulses (voltage pulses) of the oscillator circuit under the envelope that results from the AC line voltage (in this example 50 Hz). As indicated in the dashed-line region, the energization is interrupted for measuring the resonant frequency in an interval shortly before a zero crossing of the line voltage (approximately every 10 ms).

Figure 6:
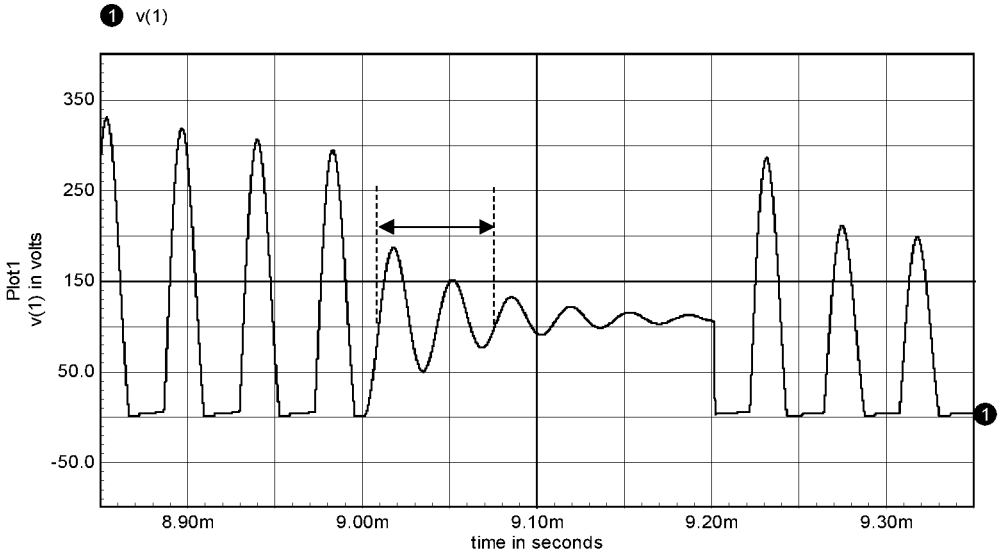
FIG. 6 shows a portion of the waveform of FIG. 5.

FIG. 6 is an enlarged view of the region marked by a dashed line in FIG. 5. In the interval from 9 ms to 9.2 ms, the energization of the oscillator circuit is interrupted to measure the resonant frequency. In the example shown here, two oscillation periods are used for this purpose.

In principle, a selectable number of periods may be used as long as the interruption of the energization does not excessively affect the output of the induction heater. Moreover, it is preferred to use the periods at the beginning of the interruption because this is when the signal is greatest.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

The invention claimed is:

1. A method for energizing an induction heater of a laundry dryer, the method comprising:

energizing the induction heater to heat a drum of the laundry dryer;

interrupting the energization of the induction heater for a time interval, allowing an oscillator circuit of the induction heater to freely oscillate;

measuring a resonant frequency of the oscillator circuit during the time interval; and determining a temperature of the drum based on the measured resonant frequency.

2. The method as recited in claim 1, further comprising:

filtering the measured resonant frequency to account for rotation of the drum.

3. The method as recited in claim 1, further comprising:

interrupting the heating of the drum or reducing the output of the induction heater if the particular temperature is above a predetermined threshold.

4. The method as recited in claim 3, wherein the predetermined threshold has a value between 45° C. and 140° C.

5. The method as recited in claim 1, wherein the induction heater is operated with AC voltage and the time interval is shortly before a zero crossing of the AC voltage.

6. The method as recited in claim 1, wherein the time interval is 1-3 periods of the oscillator circuit.

7. The method as recited in claim 6, wherein the time interval is 2 periods of the oscillator circuit.

8. An energization circuit for an induction heater of a drum of a laundry dryer, the energization circuit comprising a microcontroller configured to carry out the method as described in claim 1.

9. A laundry dryer, comprising:

an induction-heatable and rotatable drum;

an induction heater covering at least a portion of the drum and configured to heat the drum; and an energizing circuit according to claim 8 operatively connected to the induction heater.

10. The laundry dryer as recited in claim 9, further comprising an additional ferromagnetic material attached to at least one portion of the drum, the energization circuit being configured to measure the resonant frequency of the oscillator circuit during a time interval in which the induction heater covers the attached ferromagnetic material.

11. The laundry dryer as recited in claim 10, wherein the attached ferromagnetic material differs in its magnetic behavior from the material of the drum and is attached only to at least one portion of the drum, and the energization circuit is configured to detect, based on a change in the magnetic behavior, whether the drum rotates or is at rest, the energization circuit being configured to turn off the induction heater when the drum is detected to be at rest.

* * * * *